US005799840A

United States Patent [19]

Mogard

[11] Patent Number: 5,799,840

[45] Date of Patent: Sep. 1, 1998

[54] CLOSURE FORMED AS A SINGLE, INTEGRAL PART

[75] Inventor: Jens Mogard, Buffalo Grove, Ill.

[73] Assignee: Tetra Laval Holdings & Finance, S A, Pully, Switzerland

[21] Appl. No.: 648,806

[22] Filed: Apr. 25, 1996

[51] Int. Cl.[6] ..... B65D 47/10

[52] U.S. Cl. ..... 222/541.5; 222/541.9; 222/556; 220/258; 220/259; 220/339; 215/338; 229/125.14; 229/125.15

[58] Field of Search ..... 222/1, 541.5, 541.9, 222/556, 498; 220/339, 258, 259; 215/338, 335; 229/125.14, 125.15

[56] References Cited

U.S. PATENT DOCUMENTS

| | | | |
|---|---|---|---|
| 4,386,714 | 6/1983 | Roberto et al. | 215/235 X |
| 4,607,768 | 8/1986 | Taber et al. | 222/498 X |
| 4,711,372 | 12/1987 | Gach | 222/153.06 X |
| 5,065,938 | 11/1991 | Anderson | 220/339 X |
| 5,108,029 | 4/1992 | Abrams et al. | 229/125.15 X |
| 5,199,635 | 4/1993 | Abrams et al. | 229/125.15 X |
| 5,397,013 | 3/1995 | Adams et al. | 220/259 X |

FOREIGN PATENT DOCUMENTS

| | | | |
|---|---|---|---|
| 2269809 | 2/1994 | United Kingdom | 222/556 |

*Primary Examiner*—Kenneth Bomberg
*Attorney, Agent, or Firm*—Michael A. Catania

[57] ABSTRACT

A closure for a container wherein the closure has a spout with flange, a cap and a link connecting the spout and cap. The link has a joint at its connection to the spout which allows for the folding of a portion of the link toward the flange for binding thereto. The link portion may be folded into a cutout on the flange. A method of securing the closure to a container includes bonding the link portion to the flange simultaneously with the binding of the closure to a thermoplastic surface of a container using an energy emission process such as ultrasonic sealing. The closure may also have a tamper evident structure attached thereon to provide a visual indication that the closure has been opened.

15 Claims, 6 Drawing Sheets

CLOSURE FORMED AS A SINGLE, INTEGRAL PART

TECHNICAL FIELD

The present invention relates to a closure that is formed as a single, integral component. More specifically, the present invention relates to an integrally formed closure that may be formed using a single injection mold tool.

BACKGROUND

Resealable closures for containers have become popular over the years. Such closures are now routinely employed in, for example, gable-top containers and similar disposable containers. The closures are generally of two types, snap-type caps and screw-type caps, each of which are resealable over an opening of a corresponding spout.

Conventional closures have experienced limitations. Application of the conventional closures to the containers is often quite difficult and expensive. Existing systems for applying the closure to the container can be quite costly, requiring expensive tooling for spout application stations. Additionally, the closures themselves can be quite costly to produce, frequently being formed from two separate parts formed in two separate molds using two separate injection molding processes. Accordingly, the inventor has recognized that a need remains within the industry for an improved end cap which assists in overcoming the disadvantages experienced heretofore and discussed above.

SUMMARY OF THE INVENTION

A closure for a container is set forth wherein the closure comprises a spout portion having a flange, a cap portion, and a link. The link connects the spout portion to the cap portion and is connected to the flange of the spout at a first joint and to the cap portion at a second joint. The second joint may be either a hinged joint or may comprise elongated flexible member of the link. In accordance with one embodiment of the invention, the link is foldable about the first joint so that at least one portion of the link is folded toward the flange for binding thereto. In a further embodiment, the flange includes a cutout into which a portion of the link may be folded when the link is folded along the first joint. The cutout may be complete or may be in the form of a recess. The second joint is disposed to allow securement and removal of the cap portion from the spout portion when the at least one portion of the link either overlies the flange or is disposed through the cutout. The second joint preferably remains intact to allow the cap to remain attached to the spout portion even when the closure is in an open condition.

A method for securing a closure to a container is also disclosed. In accordance with the method, the at least one portion of the link is bonded in a final position concurrent with the bonding of the closure to a thermoplastic surface of the container using an energy emission process. The closure is thus formed to its final form at the same time as the closure is secured to the container using the same energy emission process. Preferably, the process is an ultrasonic sealing process in which the ultrasonic sealing horn concurrently binds the flange to the container and the at least one portion to its final bonded position.

A tamper evident structure for a closure, such as the foregoing closure, is also set forth. The tamper evident structure comprises a first member connected to the cap of the closure at a tear joint and a second member connected to the first member and dimensioned to be secured within a cutout of the flange of the spout portion of the closure. When a complete cutout is utilized, the second member is bonded to the thermoplastic surface of the container whereas it is bonded to the flange when the cutout is in the form of a recess. When the second member is bonded to either the container or the flange, the cap of the closure is prevented from being removed from the spout until a user tears the first member from the cap along the tear joint thereby providing a visual indication that the container has been opened.

Other objects and advantages of the present invention will become apparent upon reference to the accompanying detailed description when taken in conjunction with the following drawings.

DETAILED DESCRIPTION OF THE PREFERRED EMBODIMENT

Figure 1:
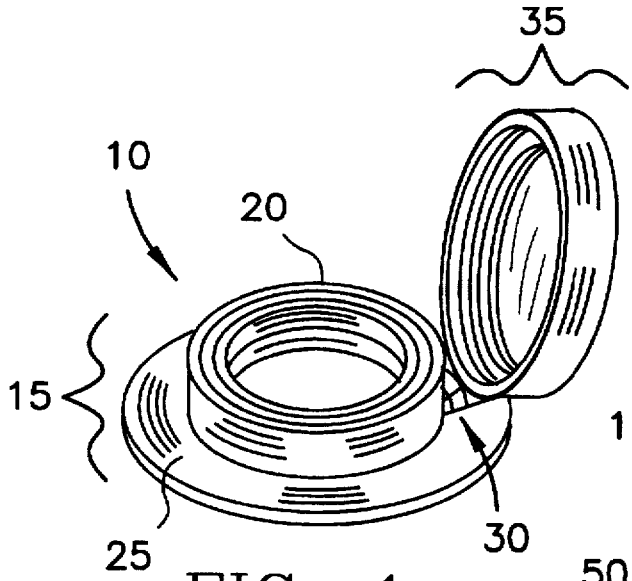
FIG. 1 is a perspective view of one embodiment of a closure in accordance with the present invention, wherein the closure is in an open condition.
Figure 2:
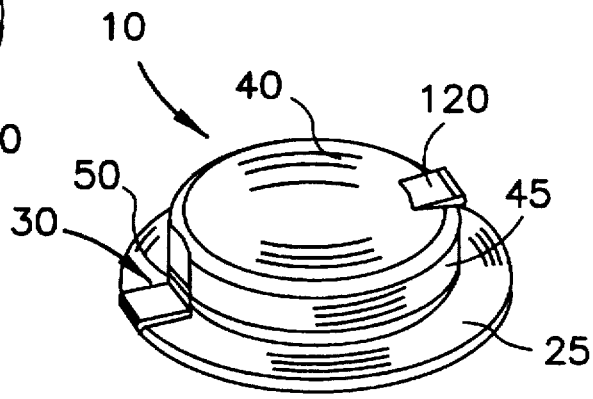
FIG. 2 is a perspective view of the embodiment of the closure of FIG. 1, wherein the closure is in a closed condition.
Figure 3:
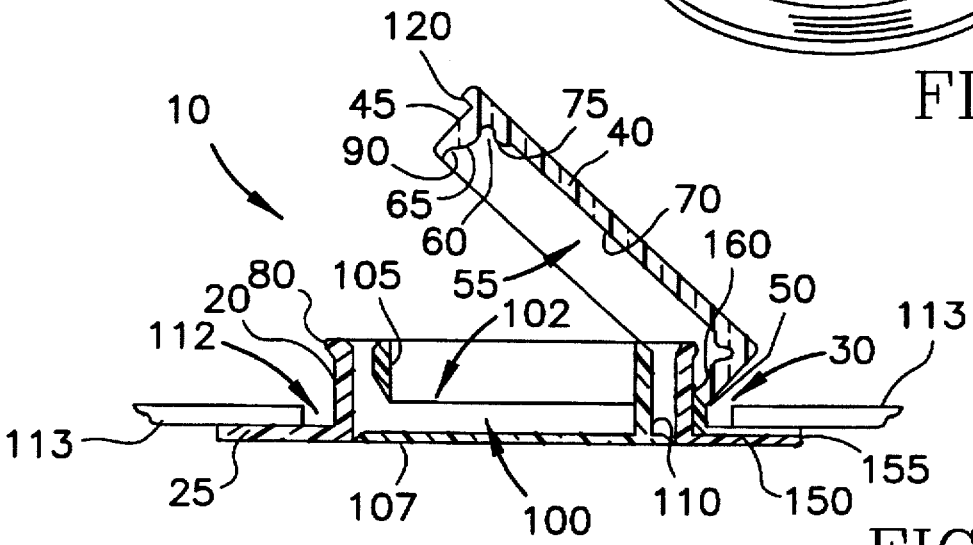
FIG. 3 is a side, cross-sectional view of the cap of FIG. 1 in a open position and secured through an aperture of a container.
Figure 4:
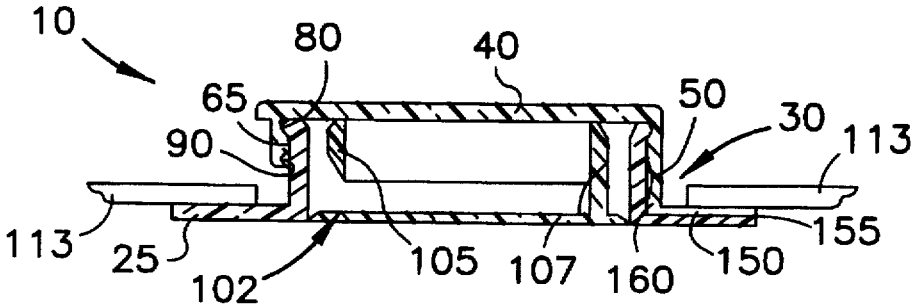
FIG. 4 is a side, cross-sectional view of the cap of FIG. 1 in an closed position and secured through an aperture of a container.

FIGS. 1–5 illustrate one embodiment of a re-sealable closure 10 that may be utilized, for example, in conjunction with a container having a body formed from a paperboard-based substrate that is disposed between outer layers of a thermoplastic polymer material or with a non-paperboard based container having exterior thermoplastic polymer layers. The closure 10 is formed as a single, integral piece and generally includes a spout portion 15 having a stem 20 which is tubular in shape and projects upward from an annular base flange 25 extending about the periphery of the lower end of the stem 20. The spout 15 is joined with a cap 35 by a hinge section 30.

Various structures are use to advantageously allow the cap 35 to resealably engage and secure with the stem 20 of the spout 15. In the particular embodiment illustrated here, the cap 35 includes an upper lid portion 40 surrounded by a downwardly projecting skirt 45. The skirt 45 and lid 40 cooperate to define an interior cavity 55 which receives an upper portion of the stem 20 when the cap 35 is secured about the stem 20 to place the closure 10 in a closed condition. An annular recess 60 is formed about the interior of the cap 35 proximate the intersection of the skirt 45 and lid 40. An interior surface of the skirt 45 includes an inner rib 65 extending about its interior. The lid 40 includes, upon its interior face 70, a circular ridge 75. The ridge 75 and the rib 65 cooperate to define the recess 60 therebetween. The stem 20 includes an upper end having an outwardly flared lip 80 extending about the exterior periphery of the stem 20. The lip 80 engages the recess 60 of the cap 35 when the closure 10 is in a closed position. The skirt 45 includes an angle surface 90 at its base to enable the cap 35 to be easily guided over the lip 80. The lip 80 and rib 65 sealably engage one another to maintain a sealed relation between the cap 35 and the stem 20.

The stem 20 further includes an opening 100 through the center thereof to enable product to be poured from the container when the cap 35 is removed. Within the spout 15 there may be disposed an optional membrane 102 over the opening 100. The optional membrane 102 includes an interior ring section 105 formed concentrically with the stem 20. The ring 105 is secured to a membrane cover 107 by a base connecting section 110 extending downward from the ring 105 along one side thereof.

A ledge 120, in any one of a variety of different shapes is formed integrally with the lid 40 and located opposite the hinge 30 to facilitate manual opening of the closure 10.

Figure 5:
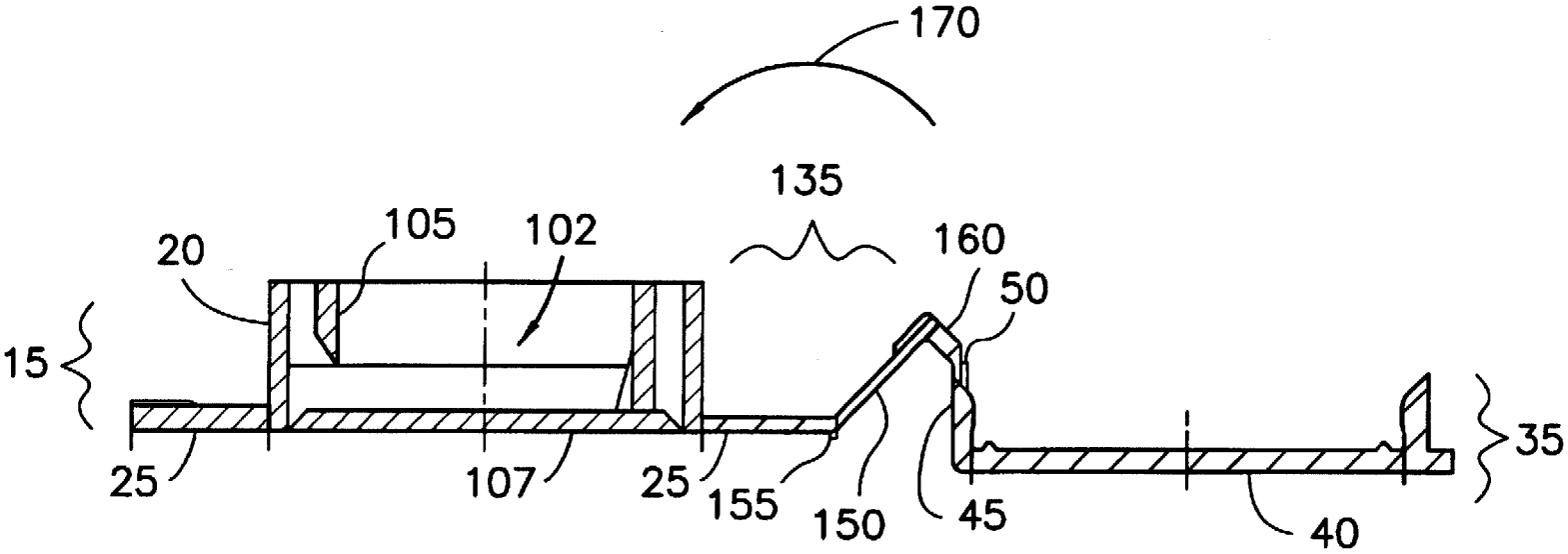
FIG. 5 is a side, cross-sectional view of the cap of FIG.1 in a fully unfolded state.

As illustrated in FIG. 5, the closure 10 is formed as a single integral structure, preferably from a thermoplastic material, through injection molding or the like. The closure 10 may be advantageously molded within a single injection molding tool in its expanded position, such as illustrated in FIG. 5. Such a molding tool is both simple and economical to form. Additionally, such a tool is easy to maintain. Overall, the single, integral structure shown here gives rise to a closure that is more economical to manufacture than other closures in common use today, such as those comprising separate cap and spout sections.

With reference to FIG. 5, the hinge portion 30 is formed from a unique cooperation of individual sections. These sections include an L-shaped link 135 having a first portion 150 connected to the flange 25 at hinged joint section 155 and a second, shorter portion 160 attached to the cap 35 at hinged joint section 50. The first portion 150 preferably has a length that is approximately equal to the width of the flange 25 in the area of the hinge portion 30. The second portion 160 preferably has a length that is less than the height of the stem 20 in the area of the hinge section 30.

In use, the closure 10 is folded along the hinged joints 50 and 155 to its closed position. In this position, the hinged section 30 is formed by folding the L-shaped link 135 in the direction of arrow 170 until the first portion 150 of link 135 overlies the flange 25 and the second portion 160 is adjacent, and preferably abuts, the stem 20. The closure 10 is then inserted into an opening 112 of a container 113. Preferably, the closure 10 is inserted to the position shown in FIG. 4 so that the flange 25 engages the interior, thermoplastic surface of the container 113. Alternatively, the closure 10 may be disposed about the opening 112 at the exterior of the container 113.

The closure 10 is preferably secured to the container 113 through ultrasonic sealing, heat sealing, or the like. Using this type of sealing, the interior thermoplastic layer of the container is brought to a plasticized state so that it melts and secures the flange 25. Concurrent with this sealing operation, an amount of the sealing energy, such as ultrasonic energy, is directed to the first portion 150 of the link 135 so that the first portion 150 is sealed to the flange 25. An ultrasonic sealing horn may be readily formed to surround the cap 45 and stem 20 and engage the area of the exterior of the container 113 about the flange. Optionally, an externally visible tamper sign may be added since the closure is sealed onto the package.

It will be recognized that the second portion or arm 160 may be, for example, in the form of an elongated loop thereby eliminating the need for the second joint 50 to operate as a hinged joint. As such, the cap 35 could be freely removed from the stem and replaced thereon without a hinged action of the second joint 50.

A standard packaging machine may be used to form the closure 10 and seal it to the container with a minimal amount of additional tooling. This is due, at least in part, to the fact that only one sealing tool, for example, ultrasonic sealing tool, is needed to facilitate the sealing. Thus, the overall cost for tooling is reduced, while part production costs and production maintenance is reduced by utilizing a single-piece, low maintenance injection molding tool in the molding process. A further advantage is that the present closure design can be preferably manufactured through a process in which the molding tool is only move along a single motion axis.

Alternative, although generally less efficient, processes for securing the closure 10 to the container are also contemplated. For example, adhesives may be used to secure the first portion 150 of the link 135 to the flange. The resulting closure may then be secured to the container by applying an adhesive that bonds the flange 25 to the container or by an energy sealing process, such as an ultrasonic sealing process, that bonds the flange to the container. Alternatively, the first portion 150 of the link 135 may be bonded to the flange 25 using an energy sealing process, and the resulting closure bonded to the container by an adhesive.

Figure 7:
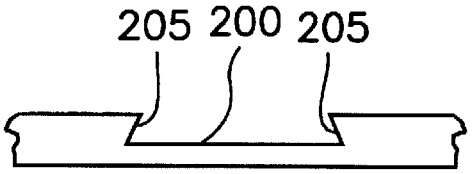
FIG. 7 is a cross-sectional view of the recess of the flange of the closure of FIG. 6.
Figure 6:
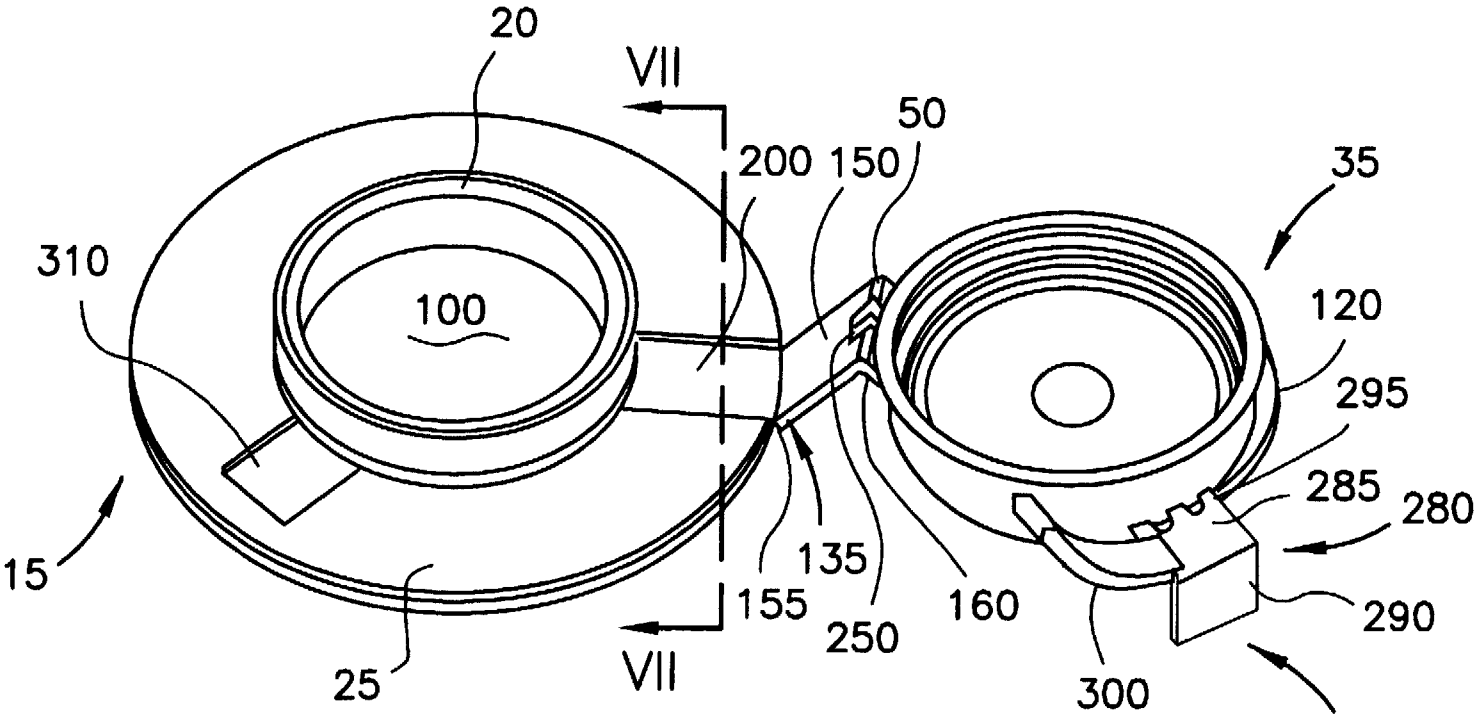
FIG. 6 is a top perspective view of an alternative embodiment of a closure in accordance with the present invention wherein the closure is in an open condition.
Figure 8:
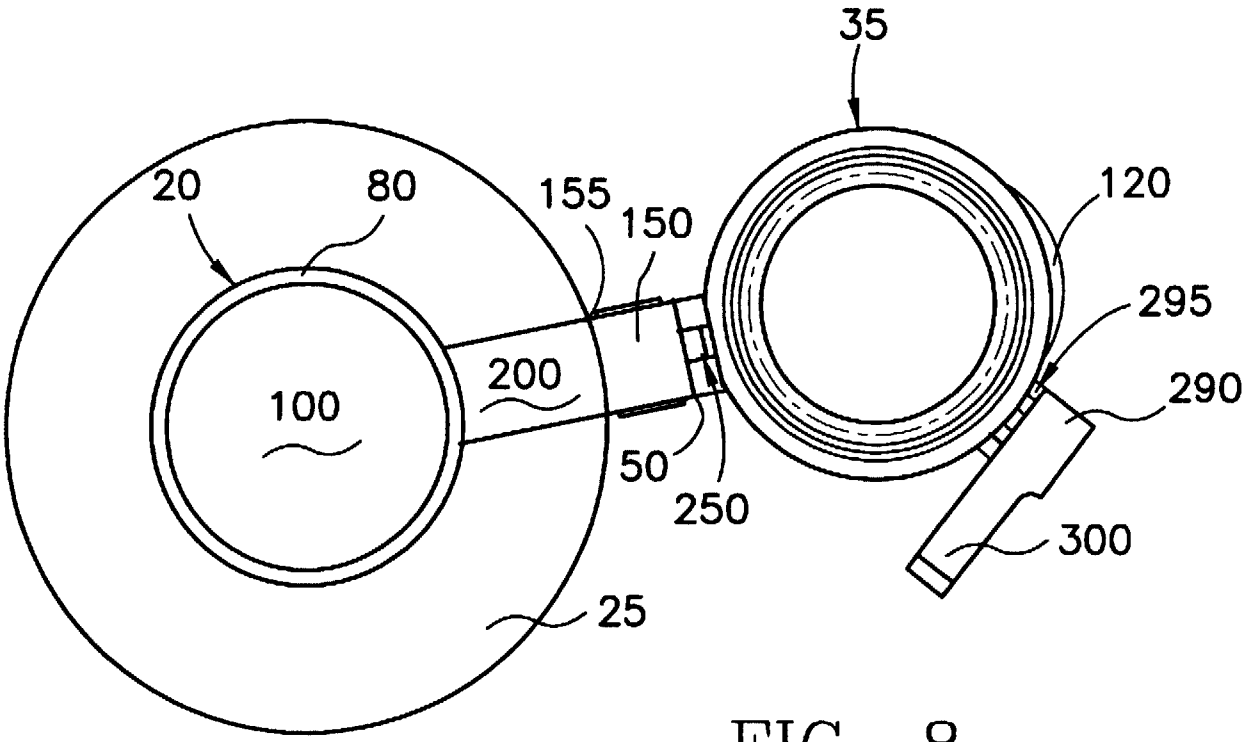
FIG. 8 is a top plan view of the closure of FIG. 6.

FIGS. 6–8 illustrate a further embodiment of the closure 10. In this embodiment, the flange 25 includes a cutout portion 200, shown here as a recess. The link 135 is secured to the flange 25 at the first joint 155 proximate the recess 200. The arm 150 has a depth that is approximately the same depth as the recess 200 so that the arm 150 fits within the recess 200 when the link 135 is folded about the first joint 155. As such, the top portion of the arm 150 is approximately level with the top level of the flange 25 when the arm 150 is disposed in the recess 200. As shown in FIG. 7, the sidewalls 205 of the recess 200 are preferably disposed at an angle, for example, of about 10 degrees. Such angular sidewalls assist in keeping the arm 150 secured within the recess 200 until such time as the closure 10 is bonded to the container by, for example, an ultrasonic, thermal, or adhesive bonding process.

The embodiment of FIGS. 6–8 is preferably disposed to close the opening 112 of the container using an energy bonding process, such as an ultrasonic sealing process. In such a process, the arm 150 is bonded within the recess concurrently with the ultrasonic bonding of the closure 10 to the container Alternative, although generally less efficient, processes for securing the closure 10 of FIGS. 6–8 to the container are also contemplated. For example, adhesives may be used to secure the first arm 150 of the link 135 within the recess 200. The resulting closure may then be secured to the container by applying an adhesive that bonds the flange 25 to the container or by an energy sealing process, such as an ultrasonic sealing process, that bonds the flange to the container. Alternatively, the first arm 150 of the link 135 may be bonded within the recess using an energy sealing process, and the resulting closure bonded to the container by an adhesive.

Figure 9:
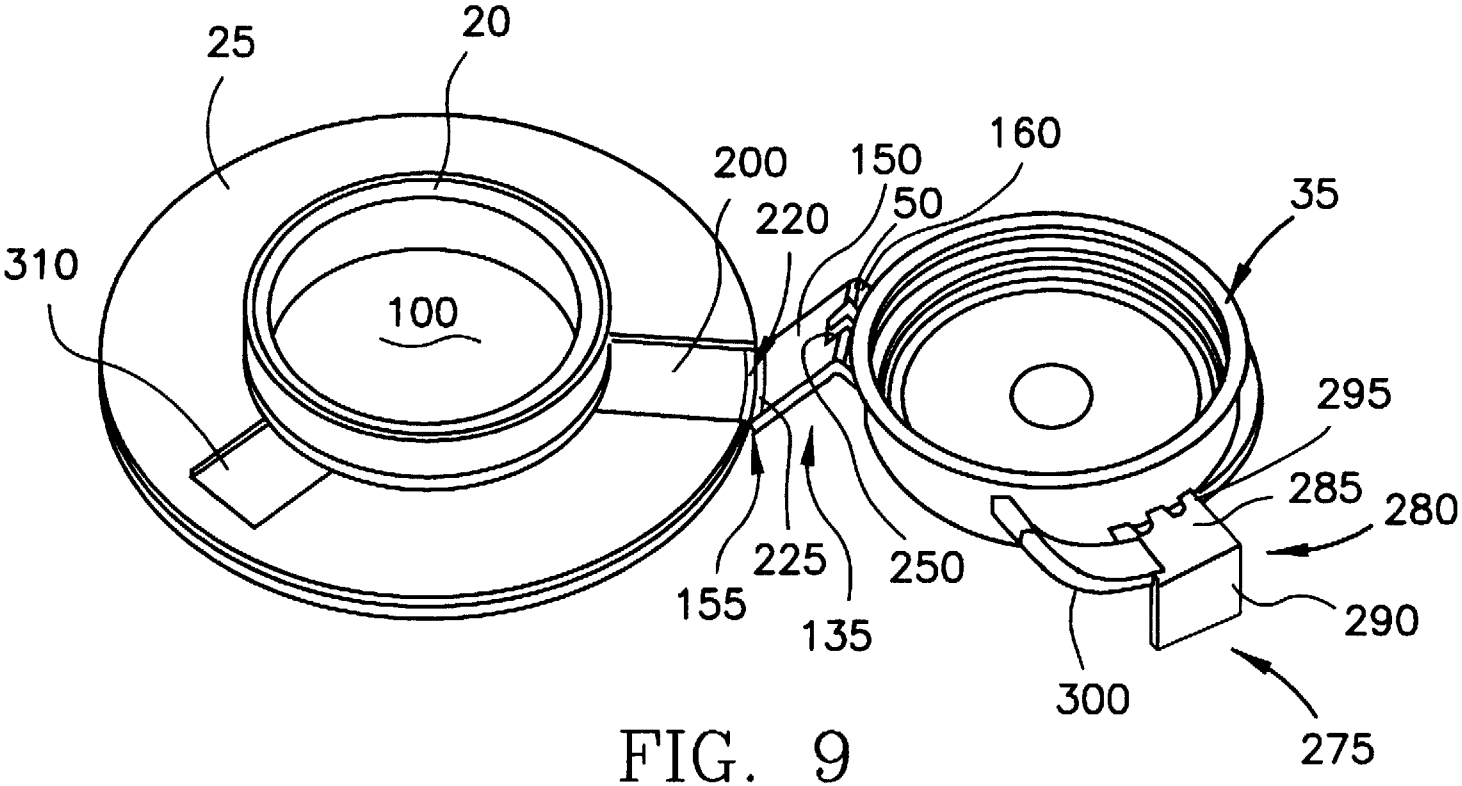
FIGS. 9 illustrates a still further embodiment of a closure in accordance with the invention.

With reference to FIG. 9, there is shown a still further embodiment of the closure 10. Here, the cutout 200 extends completely through the depth of the flange 25 except for a portion of material 220 forming the joint 155 to thereby form an open region. A corresponding portion of material 225 to the portion 220 is removed from arm 150. The remaining portion of arm 150 has a depth that is approximately equal, and preferably the same as the depth of the cutout 200. In this arrangement, the arm 150 engages cutout 200 so that the top portion of the arm 150 is generally flush with the top portion of the flange 25 while the bottom portion of the arm 150 is generally flush with the bottom portion of the flange 25. As noted above, the sidewalls of the recess 200 may be angled. As with each of the embodiments disclosed above, the embodiment of FIG. 9 is preferably disposed to close the opening 112 of the container using an energy bonding process, such as an ultrasonic sealing process. In the instant process, however, the arm 150 is secured to the thermoplastic surface of the container with the ultrasonic bonding of the closure 10 to the container concurrent with the bonding of the closure to the thermoplastic surface in the region about the opening 112 Alternative, although generally less efficient, processes for securing the closure 10 of FIG. 9 to the container are also contemplated. The closure may be secured to the container by applying an adhesive that bonds the flange 25 and arm 150 to the container.

When a user empties a container having the closure 10, the cap 35 of the closure 10 may get in the way of contents exiting from the stem 20. Accordingly, the closure 10 may be provided with one or more cooperating structures in the area of the hinge section 30 that assist in keeping the cap 35 from obstructing the flow of contents from the container. One such set of cooperating structures is disclosed herein in connection with FIGS. 6–12. As illustrated, a notched opening 250 is disposed in the link 135 proximate the second joint 50. A projection 255 extends from the cap 35 into the notched opening 250. The stem 20 includes a recessed region 260 at the exterior thereof.

Figure 10:
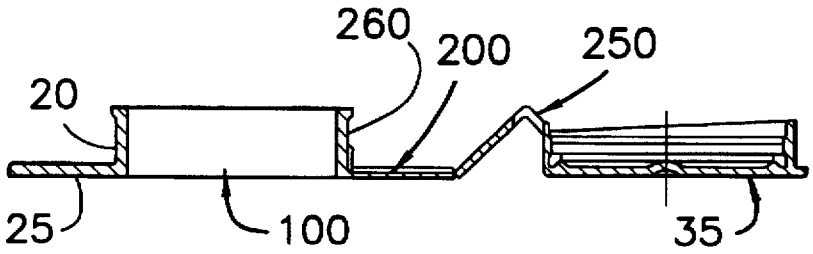
FIG. 10 is a cross-section view of the closure of FIG. 6 in an open position.
Figures 11, 11A:
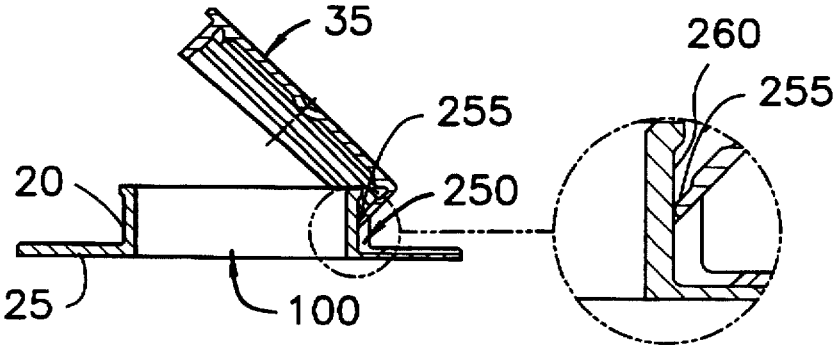
FIG. 11 is a cross-sectional view of the closure of FIG. 6 in a partially closed position.
FIG. 11A is an enlarged view of circle A of FIG. 11.
Figures 12, 12A:
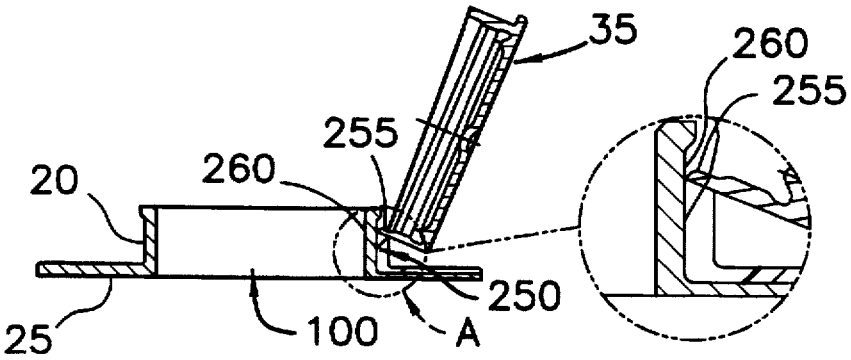
FIG. 12 is a cross-sectional view of the closure of FIG. 6 in a partially open position.
FIG. 12A is an enlarged view of circle A of FIG. 12.
Figure 13:
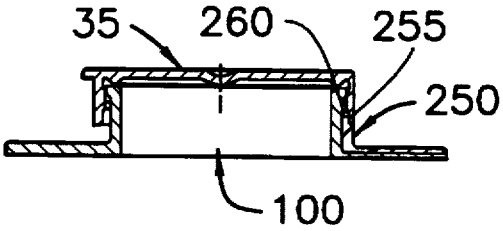
FIG. 13 is a cross-sectional view of the closure of FIG. 6 is a closed position.

Cooperation of the foregoing elements can best be described in connection with FIGS. 10–12. As illustrated in FIG. 13, the recess 260 accommodates the projection 255 when the closure 10 is in a closed state in which the cap 35 is engaged over the stem 20 to seal opening 100. As the closure 10 is manually transitioned to an open state by a user of the container, the cap 35 is rotated about joint 50 and the end of the projection 255 engages the recess 260 in the manner shown in FIGS. 11 and 11A. Further movement beyond the transitional state shown in FIGS. 11 and 11A results in a camming engagement between the projection 255 and the surface of the recess 260. The camming action resiliently urges the projection 255 and the cap 35 away from the stem 20. At some point in this transition, the projection 255 and cap 35 reach a point at which they snap to the position shown in FIGS. 12 and 12A thereby temporarily securing the cap 35 in an open position until such time as a manual closing force is applied by the user to return the cap 35 and projection 255 to the closed position of FIG. 13. While in the open position, the content of the container is allowed to flow freely from the stem 20 without interference from the cap 35.

A tamper evidence structure 275 is show in each of the embodiments of FIGS. 6–9. The tamper evidence structure 275 includes an L-shaped portion 280 having first and second arms 285 and 290. The first arm 285 is secured to the cap 35 at a tear joint 295 that, for example, includes one or more notches. A gripping arm 300 extends from the first arm 285 and, for example, may be in the form of an arcuate strip that generally conforms to the arc of the skirt 45. The flange 25 includes a cutout 310 that is dimensioned to accommodate the second arm 290 therein. As with cutout 200, the cutout 310 may merely be a recess or may be disposed completely through the flange.

When the closure 10 with the associated tamper evidence structure 275 are fully formed and sealed to the container, the second arm 290 is bonded to either the flange 25 or thermoplastic surface of the container, depending on the type of cutout employed. The cap 35 is thus secured to the spout 15 by the first arm 285 that now extends between the flange portion 25 of the spout 15 and the cap 35. To open the closure 10, the user grasps the gripping arm 300 and tears the first arm 285 from the cap 35 in the region of the tear joint 295. The notches at the tear joint 295 assist in reducing the amount of force required for this tearing. Notches or the like may similarly be used in the region of the engagement between the first and second arms 285 and 290.

Although the present invention has been described with reference to a specific embodiment, those of skill in the art will recognize that changes may be made thereto without departing from the scope and spirit of the invention as set forth in the appended claims.

I claim as my invention:

1. A container having a thermoplastic surface and a closure, the container produced according to the process comprising:

providing a closure having a spout portion with a stem and a flange, a cap portion with a lid and a skirt, and a link connecting the flange to cap portion, the link connected to the flange at a first hinged joint and the link connected to the skirt at a second hinged joint to allow for retention of the cap portion during access of the container, and at least one portion of the link overlying the flange;

positioning the closure about the container at an access site; and concurrently energy emission bonding the flange to the thermoplastic surface and to the at least one portion of the link.

2. The container according to claim 1 wherein the energy emission is an ultrasonic energy emission.

3. The container according to claim 1 wherein the energy emission is a thermal energy emission.

4. The container according to claim 1 wherein the container is a gable-top carton and the access site is an aperture through a top panel on the gable-top carton and positioning the closure comprises placing the closure through the aperture and having a portion of the flange engage an interior surface of the gable-top carton.

5. The container according to claim 1 wherein the access site is an aperture through the container and positioning the closure comprises placing the closure over the aperture and having a portion of the flange engage an exterior surface of the container.

6. A method for securing a closure to a container having a thermoplastic surface, the method comprising:

providing a closure having a spout portion with a flange and a stem, a cap portion with a skirt and a lid, and a link connecting the flange to the cap portion, the link connected to the flange at a first hinged joint and the link connected to the skirt at a second hinged joint to allow for retention of the cap portion during access of the container, and at least one portion of the link overlying the flange;

positioning the closure about the container at an access site; and concurrently energy emission bonding the flange to the thermoplastic surface and to the at least one portion of the link.

7. The method according to claim 6 wherein the energy emission is an ultrasonic energy emission.

8. The method according to claim 6 wherein the energy emission is a thermal energy emission.

9. The method according to claim 6 wherein the access site is an aperture through the container and positioning the closure comprises placing the closure through the aperture and having a portion of the flange engage an interior surface of the container.

10. The method according to claim 6 wherein the access site is an aperture through the container and positioning the closure comprises placing the closure over the aperture and having a portion of the flange engage an exterior surface of the container.

11. A closure for a container, the container having an aperture therethrough for securement of the closure thereabout, the closure comprising:

a spout portion having a stem and a flange projecting outward from the stem, the stem having an aperture therethrough;

a cap portion having a lid and a skirt projecting from the lid;

an L-shaped link connecting the flange to the skirt, the link connected to the flange at an outer edge of the flange to form a first hinged joint and the link connected to the skirt at a second hinged joint to allow for retention of the cap portion during access of the container, the link folded along the first joint so that a first portion of the link overlies and contacts the flange and a second link portion abuts the stem;

whereby the first hinged joint allows for movement of the link, and thus the cap portion, relative to the flange, and the second hinged joint allows for movement of the cap portion relative to the link.

12. The closure according to claim 11 wherein the flange includes a cutout sized to accommodate the first flange portion of the link.

13. The closure according to claim 11 further comprising a tamper evident structure disposed on the skirt.

14. The closure according to claim 11 further comprising a membrane covering the aperture of the stem, the membrane having a ring attached thereto for removal thereof.

15. The closure according to claim 11 wherein the lid and skirt form an annular recess bound by a rib portion and wherein the stem further comprises a lip disposed about the periphery thereof, the lip engaging the annual recess and being secured therein by the rib portion when the cap portion is disposed on the spout portion.

* * * * *